US008934211B2

(12) United States Patent
Takeshita et al.

(10) Patent No.: US 8,934,211 B2
(45) Date of Patent: Jan. 13, 2015

(54) SOLENOID CONTROL DEVICE

(71) Applicant: JTEKT Corporation, Osaka (JP)

(72) Inventors: Atsushi Takeshita, Toyohashi (JP); Hisaaki Wakao, Okazaki (JP); Kiyoshige Kato, Chiryu (JP); Kazuhiro Murakami, Anjo (JP)

(73) Assignee: JTEKT Corporation, Osaka-Shi (JP)

( * ) Notice: Subject to any disclaimer, the term of this patent is extended or adjusted under 35 U.S.C. 154(b) by 48 days.

(21) Appl. No.: 13/777,013

(22) Filed: Feb. 26, 2013

(65) Prior Publication Data

US 2013/0235505 A1 Sep. 12, 2013

(30) Foreign Application Priority Data

Mar. 6, 2012 (JP) ..... 2012-049327
Apr. 19, 2012 (JP) ..... 2012-095493

(51) Int. Cl.
*H01H 47/32* (2006.01)
*H01H 47/02* (2006.01)
*H01F 7/18* (2006.01)

(52) U.S. Cl.
CPC ..... *H01H 47/02* (2013.01); *H01F 7/1844* (2013.01); *H01F 2007/1888* (2013.01)
USPC ..... 361/187

(58) Field of Classification Search
USPC ..... 361/187
See application file for complete search history.

(56) References Cited

U.S. PATENT DOCUMENTS

2005/0061574 A1* 3/2005 Torizawa ..... 180/421
2006/0197508 A1 9/2006 Matsumoto et al.
2012/0014025 A1* 1/2012 Sato et al. ..... 361/93.1
2012/0080259 A1 4/2012 Ueda et al.

FOREIGN PATENT DOCUMENTS

DE 10 2007 000 854 A1 7/2008
JP A-2012-13098 1/2012

OTHER PUBLICATIONS

Jul. 16, 2013 European Search Report issued in Application No. 13156908.9.

* cited by examiner

*Primary Examiner* — Scott Bauer
(74) *Attorney, Agent, or Firm* — Oliff PLC

(57) ABSTRACT

A solenoid control device executes feedback control such that a drive current for a solenoid follows a target current, by driving, through PWM, a MOSFET provided on a power supply line to the solenoid. An overcurrent detection circuit that outputs an overcurrent detection signal when the drive current for the solenoid reaches an overcurrent determination current value is provided, and it is determined whether an overcurrent is generated. Whether a short-circuit occurs between both terminals of the solenoid is determined by monitoring whether the overcurrent detection circuit is repeating an output of the overcurrent detection signal and a stop of the output of the overcurrent detection signal.

7 Claims, 9 Drawing Sheets

[A]
Ith
DRIVE CURRENT FOR SOLENOID
0

[%]
DUTY RATIO OF PWM DRIVE SIGNAL
0

POTENTIAL OF OVERCURRENT DETECTION TERMINAL OF MICRO-COMPUTER
H
L
t1
t2
t3
t4
TIME

SOLENOID CONTROL DEVICE

INCORPORATION BY REFERENCE/RELATED APPLICATION

This application claims priority to Japanese Patent Applications No. 2012-049327 filed on Mar. 6, 2012 and No. 2012-095493 filed on Apr. 19, 2012 the disclosure of which, including the specification, drawings and abstract, is incorporated herein by reference in its entirety.

BACKGROUND OF THE INVENTION

1. Field of the Invention

The invention relates to a solenoid control device that executes feedback control such that a drive current for a solenoid follows a target current.

2. Discussion of Background

There is a solenoid control device that executes feedback control of a drive current for a solenoid, by driving, through pulse width modulation (PWM), a switching element provided on a power supply line to the solenoid. A solenoid control device described in Japanese Patent Application Publication No. 2012-13098 (JP 2012-13098 A) includes a current detection unit that detects a drive current (actual current) for a solenoid. The solenoid control device sets a target value of the drive current for the solenoid, and computes, in PWM control, a duty ratio at which there is no deviation between a current value detected by the current detection unit and the target value. Then, the solenoid control device drives the switching element through PWM, by transmitting a drive signal based on the duty ratio to a drive circuit. In this way, the solenoid control device executes feedback control of a drive current for the solenoid.

If a short-circuit occurs between both terminals of the solenoid in the solenoid control device, when the switching element is driven through PWM and is turned on, an overcurrent is generated. At this time, when the detected current value becomes larger than the target value, the solenoid control device reduces the duty ratio of the drive signal such that the detected current value becomes the target value. Thus, the drive current for the solenoid decreases to 0 amperes (A) or a value close to 0 A. Therefore, when the detected current value becomes smaller than the target value, the solenoid control device increases the duty ratio. Thus, an overcurrent is generated again. After that, a so-called hunting phenomenon occurs, that is, the drive current for the solenoid significantly fluctuates.

Previously, means for detecting an overcurrent, means for detecting a current abnormality, and the like have been proposed, and these detecting means detect an abnormality on the basis of presence of a steady abnormality, that is, on the basis of the fact that a state where a drive current for a solenoid is larger than or equal to a predetermined value continues. Therefore, with the conventional detecting means, it is not possible to appropriately detect a short-circuit between both terminals of the solenoid, which is accompanied by a hunting phenomenon. In order to take appropriate measures against a short-circuit between both terminals of the solenoid, a solenoid control device that is able to detect such an abnormality has been desired.

SUMMARY OF THE INVENTION

The invention provides a solenoid control device that is able to detect a short-circuit between both terminals of a solenoid while it is able to detect an overcurrent.

According to a feature of an example of the invention, in a solenoid control device that includes a current detection unit that detects a drive current that is supplied to a solenoid via a power supply line, and that executes feedback control such that a detected current value detected by the current detection unit follows a target current value, by driving, through pulse width modulation, a switching element provided on the power supply line, there is provided an overcurrent detection unit that outputs an overcurrent detection signal when the drive current for the solenoid reaches an overcurrent determination current value, whether an overcurrent is generated is determined on the basis of the overcurrent detection signal, and whether a short-circuit occurs between both terminals of the solenoid is determined by monitoring whether the overcurrent detection unit is repeating an output of the overcurrent detection signal and a stop of the output of the overcurrent detection signal.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Hereinafter, embodiments of the invention will be described with reference to the accompanying drawings.

A first embodiment of the invention will be described with reference to FIG. 1 to FIG. 6. First, a hydraulic power steering system of a vehicle, to which a solenoid control device according to the present embodiment is applied, will be briefly described with reference to FIG. 1.

Figure 1:
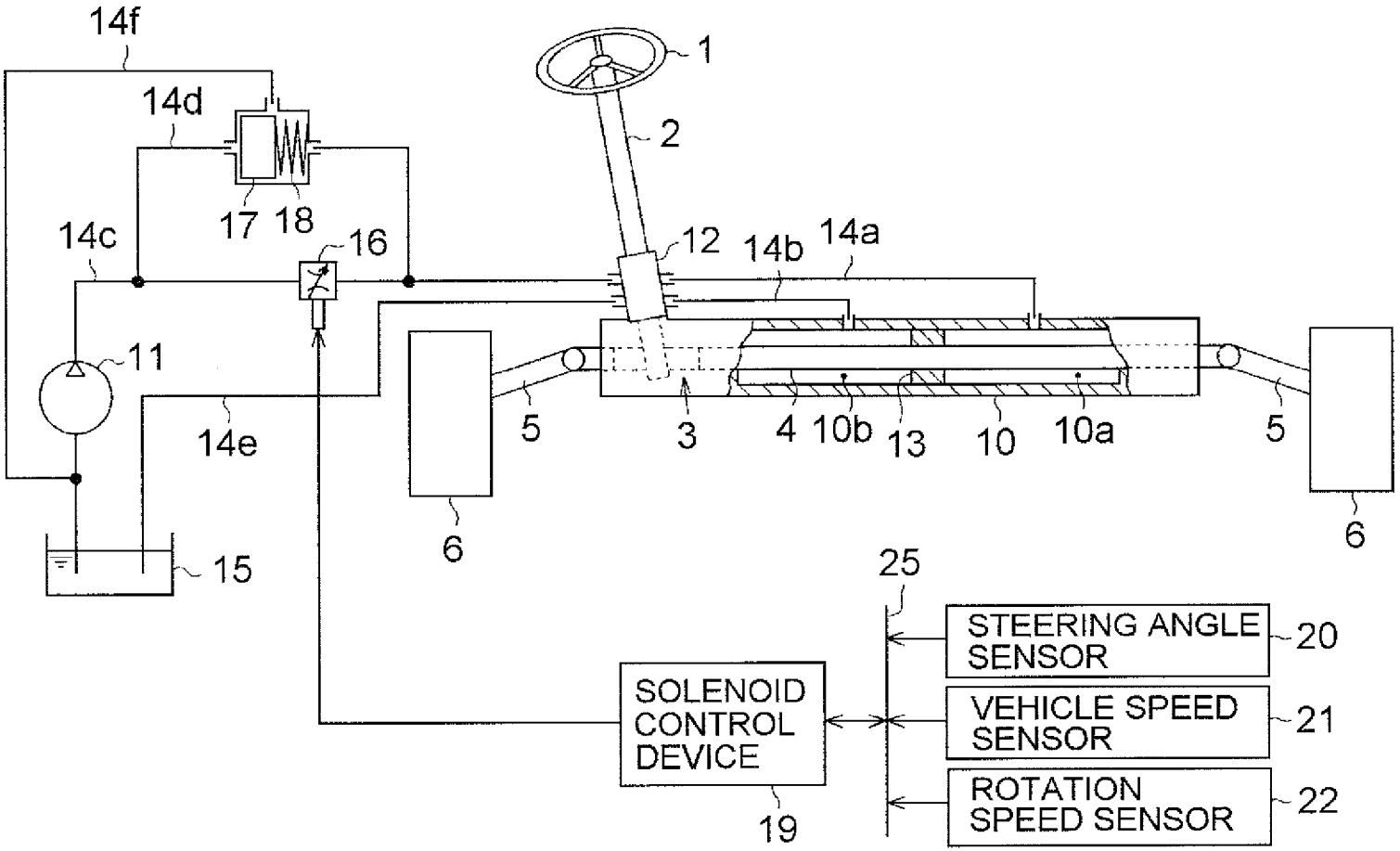
FIG. 1 is a block diagram that shows the schematic configuration of a hydraulic power steering system of a vehicle.

As shown in FIG. 1, in the hydraulic power steering system, a steering shaft 2 that serves as a rotary shaft for a steering wheel 1 is connected to the steering wheel 1. A steered shaft 4 is coupled to the lower end portion of the steering shaft 2 via a rack-and-pinion mechanism 3. When the steering shaft 2 rotates in response to a driver's operation of the steering wheel 1, the rotational motion of the steering shaft 2 is converted into an axial reciprocating linear motion of the steered shaft 4 via the rack-and-pinion mechanism 3. When the axial reciprocating linear motion of the steered shaft 4 is transmitted to steered wheels 6 via tie rods 5 that are coupled to respective ends of the steered shaft 4, the steered angle of the steered wheels 6, that is, the travel direction of the vehicle is changed.

The hydraulic power steering system serves as a mechanism that assists a driver in performing a steering operation, and includes a hydraulic cylinder 10, an oil pump 11, and a selector valve 12. The steered shaft 4 moves inside the hydraulic cylinder 10. The oil pump 11 supplies hydraulic fluid to the hydraulic cylinder 10. The selector valve 12 controls supply of hydraulic fluid to the hydraulic cylinder 10.

The hydraulic cylinder 10 includes a first hydraulic chamber 10*a* and a second hydraulic chamber 10*b* that are separated from each other by a partition wall 13 formed on the steered shaft 4. The first hydraulic chamber 10*a* is connected to the selector valve 12 via a first oil passage 14*a*, and the second hydraulic chamber 10*b* is connected to the selector valve 12 via a second oil passage 14*b*.

The oil pump 11 operates using an in-vehicle engine (not shown) as a driving source. The oil pump 11 supplies hydraulic fluid stored in a reservoir 15 to the selector valve 12 via a supply oil passage 14*c*.

The selector valve 12 is provided at an intermediate portion of the steering shaft 2. The selector valve 12 supplies/drains hydraulic fluid to/from the first hydraulic chamber 10*a* and the second hydraulic chamber 10*b* on the basis of the rotation of the steering shaft 2. Thus, a pressure difference between the first hydraulic chamber 10*a* and the second hydraulic chamber 10*b* occurs, and a force that corresponds to the pressure difference acts on the partition wall 13. The steered shaft 4 is moved in the axial direction by the force that acts on the partition wall 13. As a result, a steering operation is assisted. The hydraulic fluid is returned to the reservoir 15 via a passage 14*e*.

An electromagnetic valve 16 is provided at an intermediate portion of the supply oil passage 14*c* that connects the oil pump 11 to the selector valve 12. The electromagnetic valve 16 functions as a variable orifice. The valve opening degree of the electromagnetic valve 16 changes with a change in the amount of current that is supplied to an electromagnetic solenoid of the electromagnetic valve 16. The flow rate of hydraulic fluid that is supplied from the oil pump 11 to the selector valve 12 is adjusted on the basis of the valve opening degree of the electromagnetic valve 16. In addition, a return oil passage 14*d* is connected to the supply oil passage 14*c*. The return oil passage 14*d* connects a portion of the oil supply passage 14*c*, which is located upstream of the electromagnetic valve 16, and a portion of the oil supply passage 14*c*, which is located downstream of the electromagnetic valve 16, to each other to bypass the electromagnetic valve 16. A flow rate control valve 17 is provided on the return oil passages 14*d*. When a pressure difference between the upstream side and the downstream side of the electromagnetic valve 16 occurs due to supply of an excessive amount of hydraulic fluid from the oil pump 11 to the electromagnetic valve 16, the flow rate control valve 17 is moved against the urging force of a spring 18. Thus, excess hydraulic fluid is returned from the flow rate control valve 17 to the reservoir 15 via a passage 14*f*.

In addition, the hydraulic power steering system includes a solenoid control device 19 and various sensors 20 to 22. The solenoid control device 19 executes energization control on a solenoid of the electromagnetic valve 16. A steering angle sensor 20 detects the steering angle of the steering wheel 1. A vehicle speed sensor 21 detects the speed of the vehicle. A rotation speed sensor 22 detects the rotation speed of the in-vehicle engine. Outputs from the sensors 20 to 22 are input into the solenoid control device 19 via an in-vehicle network 25, such as a controller area network (CAN). The solenoid control device 19 computes the flow rate of hydraulic fluid that is supplied to the selector valve 12 on the basis of the steering angle, the speed of the vehicle and the rotation speed of the in-vehicle engine, which are detected by the sensors 20 to 22, respectively. The solenoid control device 19 sets a target current indicating a current that should be supplied to the solenoid of the electromagnetic valve 16 on the basis of the computed flow rate. The solenoid control device 19 executes feedback control such that a drive current for the solenoid of the electromagnetic valve 16 becomes the target value. Because the flow rate of hydraulic fluid that is supplied to the hydraulic cylinder 10 is controlled in this way, an optimal assist force based on a vehicle state is applied to a steering system, and a steering feeling improves. In addition, because a pressure loss is suppressed by the flow rate control valve 17, energy consumption is reduced.

The configuration of the solenoid control device 19 will be described with reference to FIG. 2. The solenoid control device 19 includes the solenoid 30 of the electromagnetic valve 16, an ECU 40 and a battery 50. The solenoid 30 is a subject to be controlled. The ECU 40 executes drive control on the solenoid 30. The battery 50 serves as a drive power supply source for the solenoid 30.

The battery 50 is a battery mounted on the vehicle, and is connected to the ECU 40 via an ignition switch 60. The ECU 40 includes a MOSFET 41 that serves as a switching element for allowing or interrupting supply of current from the battery 50 to the solenoid 30. The ECU 40 includes a microcomputer 43 that controls the drive current for the solenoid 30 by controlling switching of the MOSFET 41, using a drive circuit 42. Furthermore, the ECU 40 includes a current detection circuit (current detection unit) 44 and an overcurrent detection circuit (overcurrent detection unit) 46. The current detection circuit 44 detects the drive current for the solenoid 30. The overcurrent detection circuit 46 detects an overcurrent that is generated in a power supply line to the solenoid 30.

The current detection circuit 44 is provided with a shunt resistor Rs arranged on a ground line that connects the solenoid 30 to a ground. The current detection circuit 44 outputs a voltage signal corresponding to the drive current for the solenoid 30 on the basis of a voltage between both terminals of the shunt resistor Rs. The output signal from the current detection circuit 44 is smoothed by a low-pass filter 45, and is input into a current detection terminal 43*c* of the microcomputer 43.

The microcomputer 43 calculates the drive current for the solenoid 30 on the basis of the signal that is input into the current detection terminal 43*c*. The microcomputer 43 sets a target value of the drive current for the solenoid 30 on the basis of the output signals from the sensors 20 to 22, which are input into the microcomputer 43 via the in-vehicle network 25. The microcomputer 43 compares the drive current for the solenoid 30 with the target value, and computes a duty ratio that is used when the solenoid 30 is driven through PWM such that the drive current for the solenoid 30 becomes the target value. The microcomputer 43 outputs a PWM drive signal corresponding to the computed duty ratio, to the drive circuit 42. At this time, a drive pulse corresponding to the duty ratio is generated by the drive circuit 42, and the MOSFET 41 is turned on or off on the basis of the drive pulse. Thus, a current (average current) corresponding to the duty ratio is supplied to the solenoid 30. Through the above-described operation of the microcomputer 43, feedback control of the drive current for the solenoid 30 is executed such that the drive current for the solenoid 30 follows the target value.

The overcurrent detection circuit 46 is provided with a detection resistor Rd arranged on the power supply line that connects the MOSFET 41 to the battery 50. The overcurrent detection circuit 46 detects an overcurrent that is generated in the power supply line to the solenoid 30 on the basis of the voltage between both terminals of the detection resistor Rd. A diode D is connected in parallel with the solenoid 30 in order to prevent damage to the elements due to counter-electromotive force of the solenoid 30.

Figure 3:
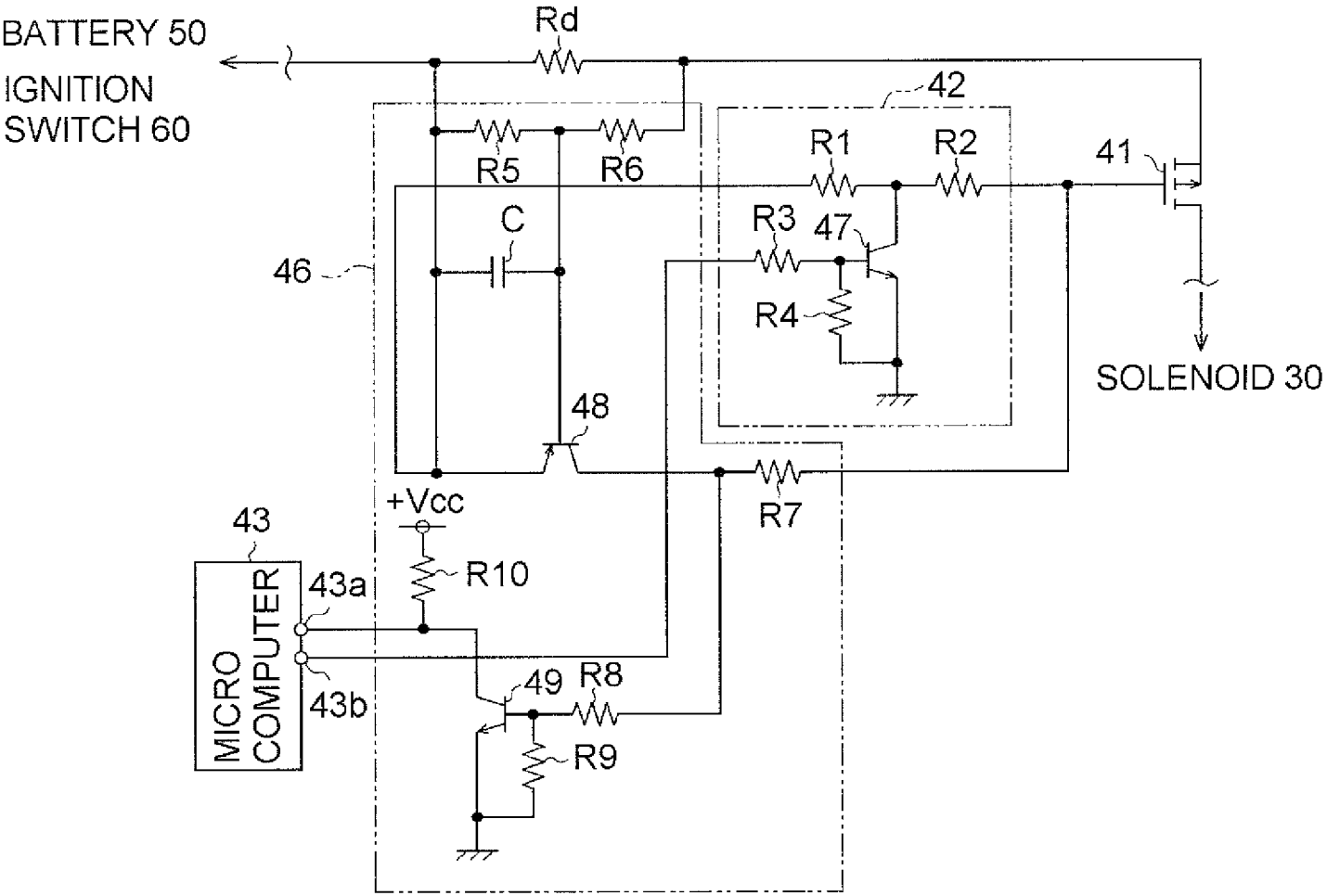
FIG. 3 is a circuit diagram that shows the circuit configuration of a drive circuit and an overcurrent detection circuit of the solenoid control device according to the first embodiment.

The circuit configuration of the drive circuit 42 and the overcurrent detection circuit 46 will be described in detail with reference to FIG. 3. A battery voltage is applied to the gate terminal of the MOSFET 41 via resistors R1, R2. Thus, the MOSFET 41 is normally in an off state. The drive circuit 42 includes a first transistor 47 for turning on or off the MOSFET 41. The collector terminal of the first transistor 47 is connected to a midpoint between the resistors R1, R2. The emitter terminal of the first transistor 47 is connected to the ground. The base terminal of the first transistor 47 is connected to a PWM control terminal 43*b* of the microcomputer 43 via a resistor R3. A resistor R4 is arranged between and connected to the base terminal and the emitter terminal of the first transistor 47. The resistor R4 is used to stabilize the operation of the first transistor 47.

A PWM drive signal that is output from the PWM control terminal 43*b* of the microcomputer 43 is input into the base terminal of the first transistor 47 via the resistor R3. Thus, on/off control on the first transistor 47 is executed in the drive circuit 42. When the first transistor 47 is turned on, the potential of the gate terminal of the MOSFET 41 becomes equal to the ground potential. Thus, the MOSFET 41 is turned on.

The overcurrent detection circuit 46 includes a series circuit formed of resistors R5, R6. The series circuit is connected in parallel with the detection resistor Rd. The overcurrent detection circuit 46 includes a second transistor 48 that is turned on when the current flowing through the detection resistor Rd reaches an overcurrent determination current value Ith.

The base terminal of the second transistor 48 is connected to a midpoint between the resistors R5, R6. The emitter terminal of the second transistor 48 is connected to the battery 50 via the ignition switch 60. The collector terminal of the second transistor 48 is connected to the gate terminal of the MOSFET 41 via a resistor R7. A capacitor C is connected in parallel with the resistor R5.

In the overcurrent detection circuit 46, as the current flowing through the detection resistor Rd increases and a voltage drop in the detection resistor Rd increases, a voltage drop at the midpoint between the resistors R5, R6 also increases. Thus, a voltage that is applied to the base terminal of the second transistor 48 decreases, and the second transistor 48 is turned on.

In the overcurrent detection circuit 46, the resistances of the resistors R5, R6 are set such that the second transistor 48 enters an on state when the current flowing through the detection resistor Rd reaches the overcurrent determination current value Ith. In the case where the second transistor 48 is in an on state, when the first transistor 47 of the drive circuit 42 is turned on, a voltage corresponding to divided voltage values of the resistors R2 and resistor R7 is applied to the gate terminal of the MOSFET 41, and the MOSFET 41 enters an off state. By controlling the gate voltage of the MOSFET 41, the drive current for the solenoid 30 is suppressed. As a result, the solenoid control device 19 is protected from an overcurrent.

The overcurrent detection circuit 46 includes a third transistor 49 that changes the potential of an overcurrent detection terminal 43*a* of the microcomputer 43 when the second transistor 48 enters an on state, that is, when an overcurrent is detected.

The base terminal of the third transistor 49 is connected to a midpoint between the second transistor 48 and the resistor R7 via the resistor R8. The collector terminal of the third transistor 49 is connected to the overcurrent detection terminal 43*a* of the microcomputer 43. The emitter terminal of the third transistor 49 is connected to the ground. A resistor R9 is arranged between and connected to the base terminal and the emitter terminal of the third transistor 49, and stabilizes the operation of the third transistor 49. A predetermined reference voltage ("+Vcc") is also applied to the overcurrent detection terminal 43*a* of the microcomputer 43 via a resistor R10, and the potential of the overcurrent detection terminal 43*a* is normally a potential corresponding to the reference voltage (logically, a high-level potential).

In the overcurrent detection circuit 46, when the second transistor 48 enters an on state, the battery voltage is applied to the base terminal of the third transistor 49 via the resistor R8, and the third transistor 49 is turned on. Thus, the potential of the overcurrent detection terminal 43*a* of the microcomputer 43 changes to a potential corresponding to the ground potential (logically, a low-level potential). Therefore, the microcomputer 43 is able to detect an overcurrent on the basis of the fact that the potential of the overcurrent detection terminal 43*a* changes from the high-level potential to the low-level potential. In the present embodiment, the low-level signal that is output from the overcurrent detection circuit 46 to the overcurrent detection terminal 43*a* is an overcurrent detection signal.

Figure 2:
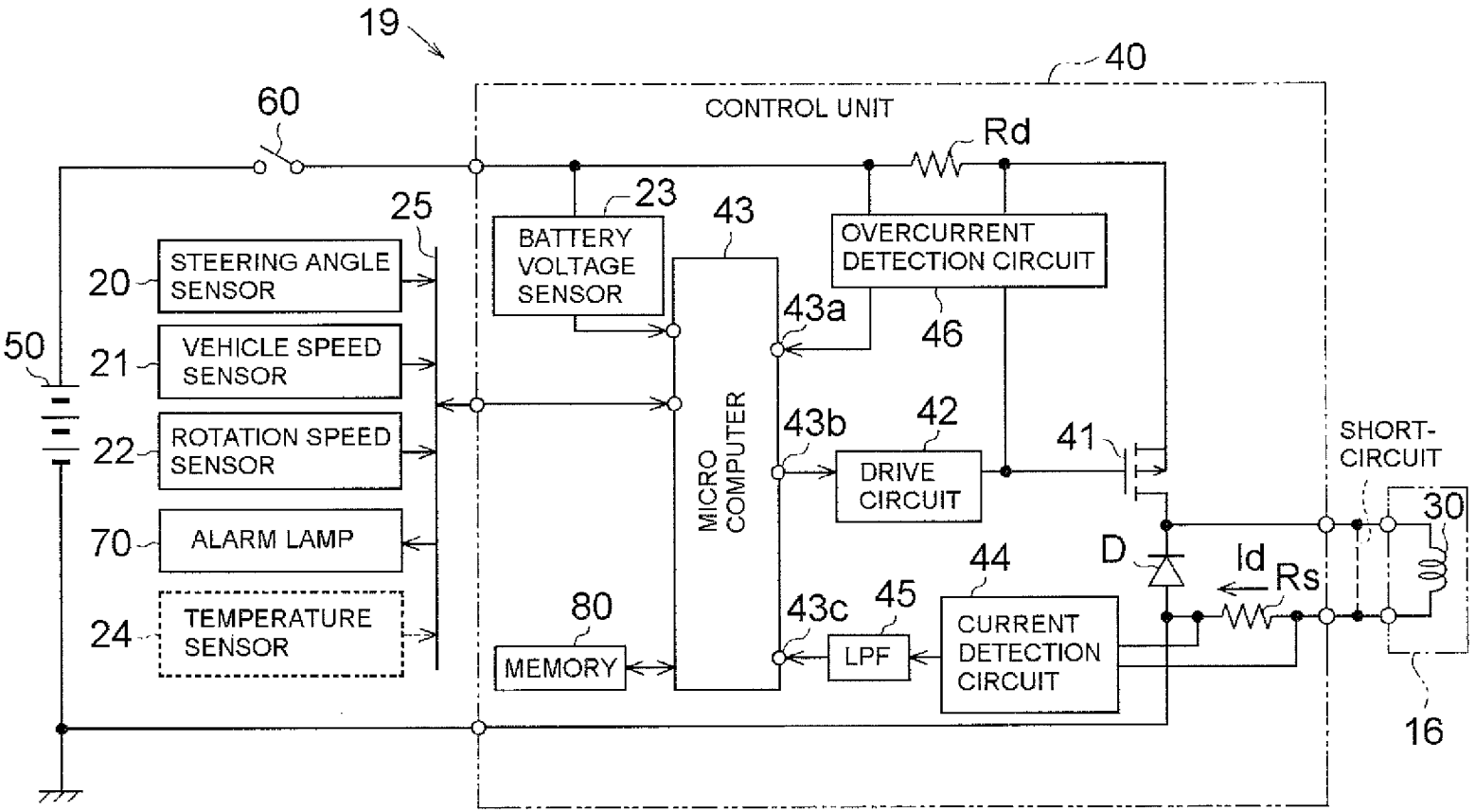
FIG. 2 is a block diagram that shows the configuration of a solenoid control device according to a first embodiment of the invention.
Figures 4A, 4B, 4C:
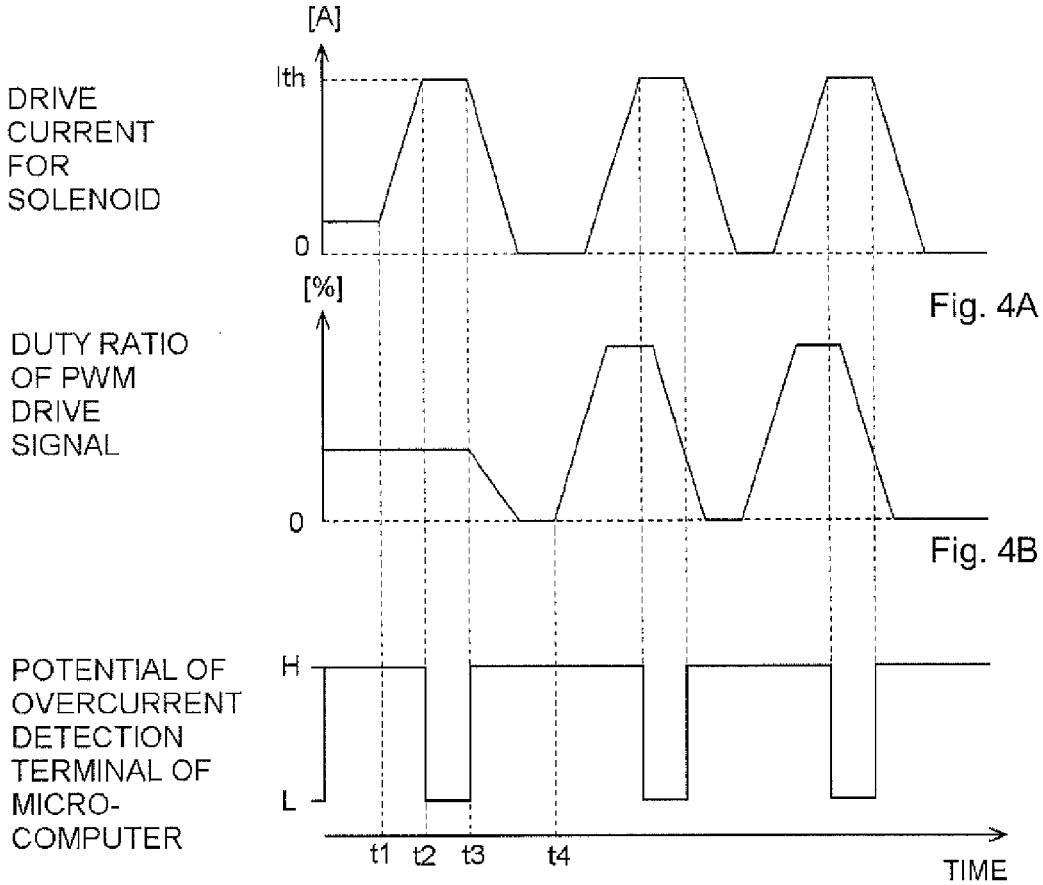
FIG. 4A to FIG. 4C are timing charts that show an example of an operation of the solenoid control device according to the first embodiment.

As indicated by a dashed line in FIG. 2, when a short-circuit occurs between both terminals of the solenoid 30 due to, for example, adhesion of foreign matter, the solenoid control device 19 operates as shown in FIG. 4A to FIG. 4C. First, if a short-circuit occurs between both terminals of the solenoid 30 at time t1, the drive current (actual drive current) for the solenoid 30 starts increasing at time t1 as shown in FIG. 4A. At this time, because a current (detected current value) Id that is detected by the current detection circuit 44 has a delay due to the low-pass filter 45, the microcomputer 43 is not able to detect an increase in the drive current at time t1. Therefore, as shown in FIG. 4B, the duty ratio of the PWM drive signal does not change. Then, as shown in FIG. 4A, when the actual drive current reaches the overcurrent determination current value Ith at time t2, the actual drive current is suppressed by the overcurrent detection circuit 46.

After that, the microcomputer 43 detects the fact that the detected current value Id is larger than the target value at time t3 at which a time corresponding to a delay in detection of the drive current has elapsed after time t1. At this time, the microcomputer 43 reduces the duty ratio of the PWM drive signal to "0" as shown in FIG. 4B so that the detected current value Id becomes the target value. As a result, as shown in FIG. 4A, the actual drive current decreases to "0 A". Then, when the microcomputer 43 detects at time t4 that the detected current value Id is smaller than the target value, the microcomputer 43 increases the duty ratio of the PWM drive signal as shown in FIG. 4B. After that, increases and decreases in the duty ratio of the PWM drive signal are repeated. Thus, as shown in FIG. 4A, the actual drive current repeatedly fluctuates between the overcurrent determination current value Ith and "0 A", that is, a hunting phenomenon occurs.

When such a hunting phenomenon due to fluctuations in duty ratio occurs, the potential of the overcurrent detection terminal 43*a* of the microcomputer 43 changes from the high-level potential to the low-level potential at time t2 at which the actual drive current reaches the overcurrent determination current value Ith as shown in FIG. 4C. The potential of the overcurrent detection terminal 43*a* changes from the low-level potential to the high-level potential at time t3 at which the actual drive current becomes smaller than the overcurrent determination current value Ith. After that as well, the potential of the overcurrent detection terminal 43*a* repeatedly changes between the low-level potential and the high-level potential on the basis of a change in the actual drive current.

The microcomputer 43 according to the present embodiment determines that a short-circuit has occurred between both terminals of the solenoid 30 when a state where the potential of the overcurrent detection terminal 43*a* changes from the high-level potential to the low-level potential continues, that is, the overcurrent detection circuit 46 is repeating an output of the overcurrent detection signal and a stop of the output of the overcurrent detection signal. When a short-circuit has occurred between both terminals of the solenoid 30, the duty ratio of the PWM drive signal is set to a fixed value Da. Thus, the duty ratio no longer increases, and it is therefore possible to prevent damage to the elements due to an overcurrent. Furthermore, as shown in FIG. 2, the microcomputer 43 issues an alarm to the driver by turning on an alarm lamp 70 provided on, for example, an instrument panel of the vehicle, via the in-vehicle network 25.

The microcomputer 43 according to the present embodiment sets the duty ratio fixed value Da such that the actual drive current reaches the overcurrent determination current value Ith when the PWM drive signal is in an on state. Thus, during a period in which there is a short-circuit between both terminals of the solenoid 30, the overcurrent detection circuit 46 in actuated in response to entry of the PWM drive signal into an on state, and the state where the potential of the overcurrent detection terminal 43*a* changes from the high-level potential to the low-level potential continues. When the short-circuit between both terminals of the solenoid 30 is eliminated, the actual drive current becomes smaller than the overcurrent determination current value Ith. Therefore, the potential of the overcurrent detection terminal 43*a* is kept at the high-level potential. Therefore, the microcomputer 43 monitors the potential of the overcurrent detection terminal 43*a* also during a period in which the duty ratio is fixed. When the potential is continuously kept at the high-level potential, the microcomputer 43 determines that the short-circuit has been eliminated. When it is determined that the short-circuit has been eliminated, fixation of the duty ratio is cancelled, and the alarm lamp 70 is turned off.

On the other hand, when the voltage of the battery 50 that serves as the drive power supply source for the solenoid 30 decreases, the actual drive current decreases. Therefore, in order to reliably actuate the overcurrent detection circuit 46 in response to entry of the PWM drive signal into an on state when the duty ratio is fixed, it is desirable to increase the duty ratio fixed value Da as the battery voltage decreases.

As shown in FIG. 2, the microcomputer 43 according to the present embodiment detects the voltage of the battery 50 using a battery voltage sensor 23, and sets the duty ratio fixed value Da to, for example, a value within the range of 5% to 10% on the basis of the detected battery voltage. The correlation between the duty ratio fixed value Da and the battery voltage is obtained through, for example, an experiment in advance, and the correlation is expressed in the form of a map and stored in a memory 80 of the ECU 40 shown in FIG. 2. The voltage of the battery 50 may be obtained by supplying an output from a battery voltage sensor provided outside of the ECU 40, to the microcomputer 43 via the in-vehicle network 25.

Next, a short-circuit occurrence detection process and a short-circuit elimination detection process that are executed by the microcomputer 43 will be described with reference to FIG. 5 and FIG. 6. The short-circuit occurrence detection process together with its operation will be described with reference to FIG. 5. The microcomputer 43 repeatedly executes the process shown in FIG. 5 at predetermined computation intervals. A value of a short-circuit detection counter CDS is set to "0" as an initial value of the short-circuit detection counter CDS.

Figure 5:
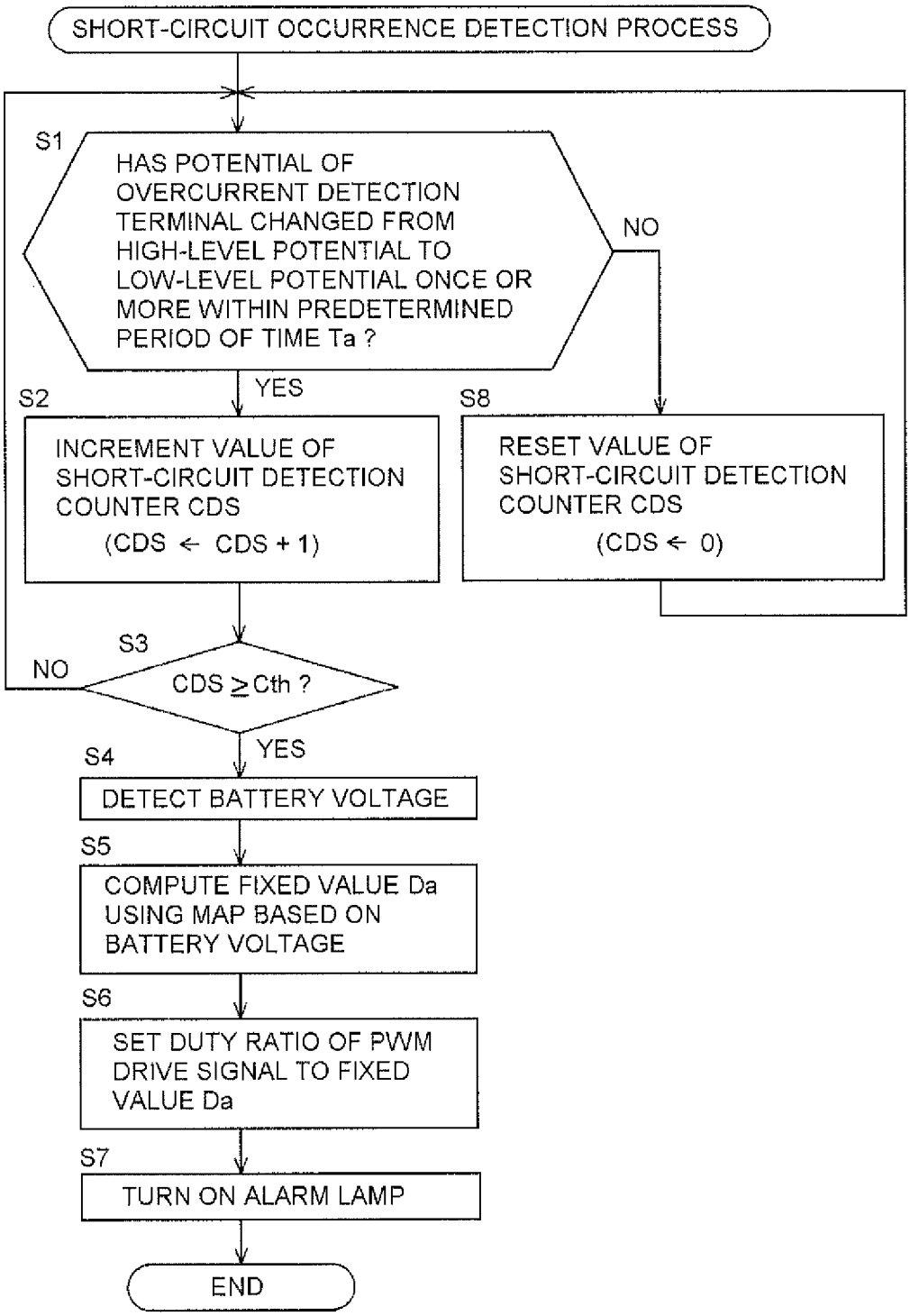
FIG. 5 is a flowchart that shows the procedure of a short-circuit occurrence detection process that is executed by the solenoid control device according to the first embodiment.

As shown in FIG. 5, in this process, first, the microcomputer 43 determines whether the potential of the overcurrent detection terminal 43*a* has changed from the high-level potential to the low-level potential once or more during a predetermined period of time Ta (step S1). The predetermined period of time Ta is set through, for example, an experiment in advance such that, during the predetermined period of time Ta, it is possible to detect once or more a phenomenon that the potential of the overcurrent detection terminal 43*a* changes from the high-level potential to the low-level potential when the hunting phenomenon illustrated in FIG. 4A to FIG. 4C occurs. If the potential of the overcurrent detection terminal 43*a* does not change from the high-level potential to the low-level potential within the predetermined period of time Ta (NO in step S1), the microcomputer 43 resets the value of the short-circuit detection counter CDS (step S8), and returns the process to step S1.

On the other hand, if a short-circuit occurs between both terminals of the solenoid 30, the potential of the overcurrent detection terminal 43*a* changes from the high-level potential to the low-level potential once or more within the predetermined period of time Ta. When the microcomputer 43 detects this phenomenon (YES in step S1), the microcomputer 43 increments the value of the short-circuit detection counter CDS (step S2). The microcomputer 43 determines whether the value of the short-circuit detection counter CDS is larger than or equal to a determination value Cth (step S3). When the value of the short-circuit detection counter CDS is smaller than the determination value Cth (NO in step S3), the microcomputer 43 returns the process to step S1.

When the state where the potential of the overcurrent detection terminal 43*a* changes from the high-level potential to the low-level potential once or more within the predetermined period of time Ta continues even after the microcomputer 43 returns the process to step S1, the microcomputer 43 repeatedly executes the process of step S2. Thus, the value of the short-circuit detection counter CDS increases. When the value of the short-circuit detection counter CDS reaches the determination value Cth (YES in step S3), the microcomputer 43 determines that a short-circuit has occurred between both terminals of the solenoid 30. At this time, the microcomputer 43 detects the battery voltage with the use of the battery voltage sensor 23 (step S4). The duty ratio fixed value Da is computed on the basis of the map that shows the correlation between the battery voltage and the duty ratio fixed value Da, which is stored in the memory 80 (step S5), and the duty ratio of the PWM drive signal is set to the fixed value Da (step S6). Thus, fluctuations in the duty ratio are eliminated. The microcomputer 43 turns on the alarm lamp 70 (step S7). Thus, the driver is able to easily recognize occurrence of an abnormality.

After the duty ratio of the PWM drive signal is fixed, while there is a short-circuit between both terminals of the solenoid 30, the potential of the overcurrent detection terminal 43*a* changes between the high-level potential and the low-level potential once or more within the predetermined period of time Ta. Therefore, the microcomputer 43 repeatedly executes the process of step S6. Thus, the duty ratio fixed value Da is changed on the basis of the present battery voltage. Thus, while there is a short-circuit between both terminals of the solenoid 30, it is possible to reliably maintain the state where the potential of the overcurrent detection terminal 43*a* changes from the high-level potential to the low-level potential.

Next, the short-circuit elimination detection process together with its operation will be described with reference to FIG. 6. The microcomputer 43 executes the process shown in FIG. 6 after the duty ratio is fixed. A value of a short-circuit elimination counter CDR is set to "0" as an initial value of the short-circuit elimination counter CDR.

Figure 6:
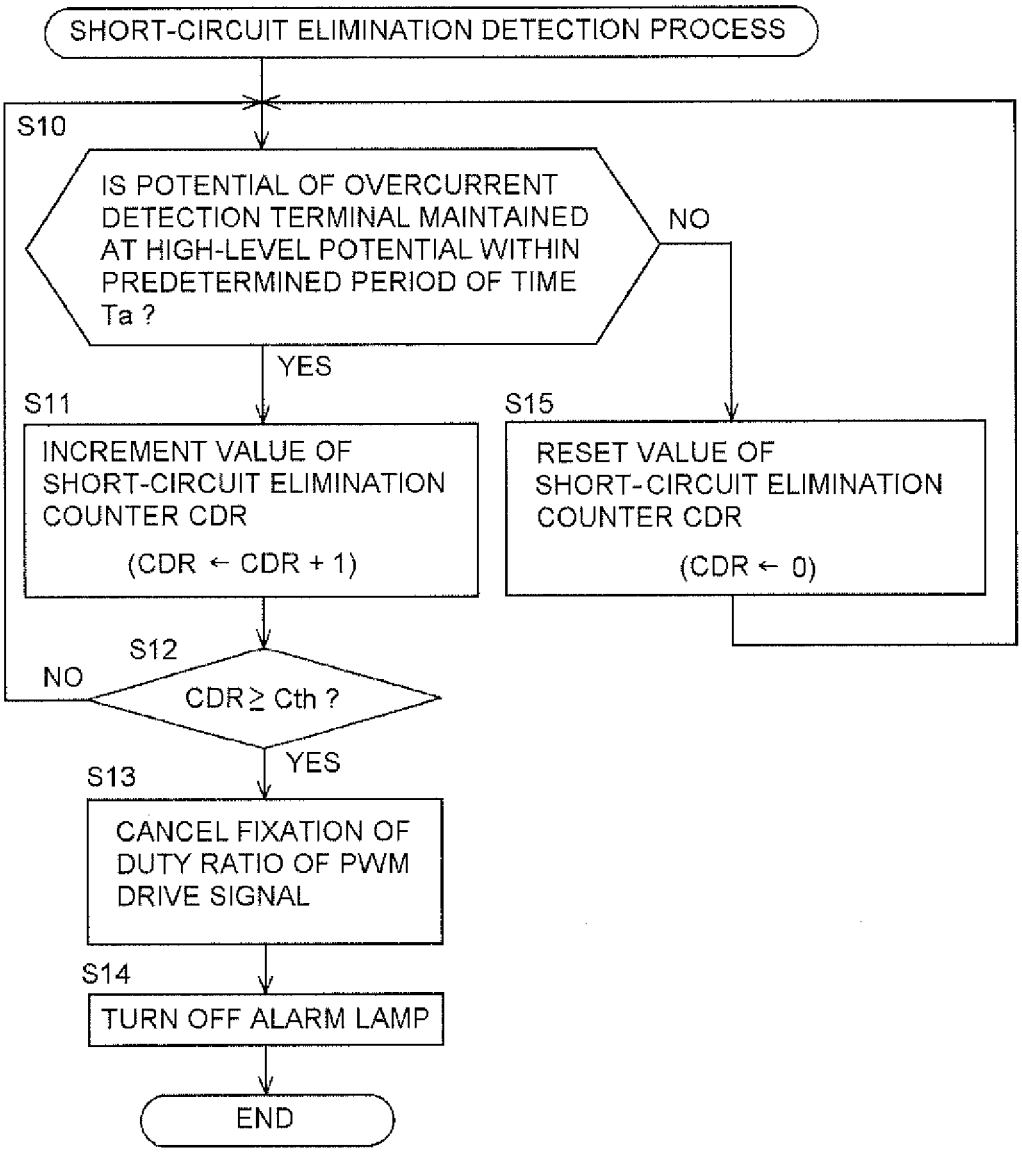
FIG. 6 is a flowchart that shows the procedure of a short-circuit elimination detection process that is executed by the solenoid control device according to the first embodiment.

As shown in FIG. 6, first, the microcomputer 43 determines whether the potential of the overcurrent detection terminal 43*a* is kept at the high-level potential for the predetermined period of time Ta (step S10). When there is still a short-circuit between both terminals of the solenoid 30, the potential of the overcurrent detection terminal 43*a* changes from the high-level potential to the low-level potential once or more within the predetermined period of time Ta. When the microcomputer 43 detects this phenomenon (NO in step S10), the microcomputer 43 resets the value of the short-circuit elimination counter CDR (step S15), and returns the process to step S10.

On the other hand, when the short-circuit has been eliminated, the potential of the overcurrent detection terminal 43*a* is kept at the high-level potential within the predetermined period of time Ta. When the microcomputer 43 detects this phenomenon (YES in step S10), the microcomputer 43 increments the value of the short-circuit elimination counter CDR (step S11). In addition, the microcomputer 43 determines whether the value of the short-circuit elimination counter CDR is larger than or equal to the determination value Cth (step S12). When the value of the short-circuit elimination counter CDR is smaller than the determination value Cth (NO in step S12), the microcomputer 43 returns the process to step S10.

If the potential of the overcurrent detection terminal 43*a* is kept at the high-level potential within the predetermined period of time Ta even after the microcomputer 43 returns the process to step S10, the microcomputer 43 repeatedly executes the process of step S11. Thus, the value of the short-circuit elimination counter CDR increases. When the value of the short-circuit elimination counter CDR reaches the determination value Cth (YES in step S12), the microcomputer 43 determines that the short-circuit has been eliminated. At this time, the microcomputer 43 cancels fixation of the duty ratio (step S13), and resumes the operation of the solenoid control device. In the present embodiment, the operation of the solenoid control device is automatically resumed when the short-circuit is eliminated as described above. As a result, convenience improves. In addition, the microcomputer 43 turns off the alarm lamp 70 (step S14). Thus, the driver is able to easily recognize that the abnormality has been eliminated.

As described above, with the solenoid control device according to the present embodiment, the following advantageous effects are obtained.

(1) The solenoid control device 19 includes the overcurrent detection circuit 46 that outputs an overcurrent detection signal to the microcomputer 43 when the drive current for the solenoid 30 reaches the overcurrent determination current value. Then, the solenoid control device 19 determines whether an overcurrent is generated, on the basis of the overcurrent detection signal. In addition, the solenoid control device 19 monitors whether the overcurrent detection circuit 46 is repeating an output of the overcurrent detection signal and a stop of the output of the overcurrent detection signal. In this way, the solenoid control device 19 detects a short-circuit between both terminals of the solenoid 30. Thus, the solenoid control device 19 is able to detect a short-circuit between both terminals of the solenoid 30 while it is able to detect an overcurrent.

(2) When there occurs a short-circuit between both terminals of the solenoid 30, the duty ratio significantly fluctuates due to feedback control of the current. At this time, if the duty ratio becomes excessively high, various elements including the MOSFET 41 may be damaged due to an overcurrent. In contrast to this, when the solenoid control device 19 detects a short-circuit between both terminals of the solenoid 30, the duty ratio of the PWM drive signal for the MOSFET 41 is set to the fixed value Da. Thus, it is possible to prevent various elements from being damaged due to an overcurrent caused by an increase in the duty ratio. The fixed value Da is set such that the drive current reaches the overcurrent determination current value when the PWM drive signal is in an on state. Therefore, the solenoid control device 19 keeps monitoring whether the overcurrent detection terminal 43*a* is repeating an output of the overcurrent detection signal and a stop of the output of the overcurrent detection signal. In this way, it is possible to determine whether the short-circuit has been eliminated.

(3) The solenoid control device 19 sets the fixed value Da on the basis of the battery voltage. Specifically, the fixed value Da is set to a larger value as the battery voltage decreases. In this way, each time the PWM drive signal enters an on state, it is possible to reliably increase the drive current to the overcurrent determination current value Ith. As a result, the solenoid control device 19 is able to further accurately determine whether the short-circuit between both terminals of the solenoid 30 has been eliminated.

(4) The solenoid control device 19 cancels fixation of the duty ratio when the solenoid control device 19 determines that the short-circuit between both terminals of the solenoid 30 has been eliminated. Therefore, no specific operation for resuming the operation of the solenoid control device 19 is required. As a result, convenience improves.

(5) When the solenoid control device 19 detects a short-circuit between both terminals of the solenoid 30, the solenoid control device 19 turns on the alarm lamp 70. In addition, when the solenoid control device 19 determines that the short-circuit has been eliminated, the solenoid control device 19 turns off the alarm lamp 70. In this way, the driver is able to easily recognize occurrence of a short-circuit and elimination of the short-circuit.

Next, a second embodiment of the invention will be described. Hereinafter, differences from the first embodiment will be mainly described. If noise is generated in the various elements of the overcurrent detection circuit 46 illustrated in FIG. 2, the overcurrent detection circuit 46 may erroneously detect an overcurrent and may repeatedly output the low-level signal. In such a situation, if the solenoid control device 19 executes the short-circuit occurrence detection process shown in FIG. 5, the solenoid control device 19 may fix the duty ratio of the PWM drive signal on the basis of the output from the overcurrent detection circuit 46 or turn on the alarm lamp 70 although there is actually no short-circuit between both terminals of the solenoid 30.

On the other hand, when the duty ratio of the PWM drive signal is fixed, the drive current for the solenoid 30 becomes constant. Therefore, the current value Id (actually, the average of the current value) that is detected by the current detection circuit 44 indicates a constant value. Therefore, if the current value detected by the current detection circuit 44 is measured through, for example, an experiment in a state where the duty ratio is set to the fixed value Da while there is no short-circuit, it is possible to measure a normal value of the detected current value in advance.

Therefore, in the present embodiment, a current value that is detected by the current detection circuit 44 in a state where the duty ratio is set to the fixed value Da while there is no short-circuit is measured through, for example, an experiment in advance, and the measured value is stored in the memory 80 as a normal value In. In addition, a current value that is detected by the current detection circuit 44 in a state where the duty ratio is set to the fixed value Da while there is a short-circuit is measured through, for example, an experiment in advance, and the measured value is stored in the memory 80 as an abnormal value Ie. In the case where the duty ratio has been fixed in the short-circuit occurrence detection process, the solenoid control device 19 cancels fixation of the duty ratio on the condition that the detected current value Id detected by the current detection circuit 44 is the normal value In. On the other hand, in the case where the duty ratio has been fixed, the solenoid control device 19 turns on the alarm lamp 70 on the condition that the detected current value Id detected by the current detection circuit 44 is the abnormal value Ie.

On the other hand, if noise is generated in the various elements of the overcurrent detection circuit 46, the overcurrent detection circuit 46 is not able to appropriately detect an overcurrent, and may not output a low level signal even when an overcurrent is generated. In such a situation, if the solenoid control device 19 according to the first embodiment executes the short-circuit elimination detection process shown in FIG. 6, the solenoid control device 19 may erroneously detect elimination of the short-circuit and therefore cancel fixation of the duty ratio or turn off the alarm lamp 70.

Then, when the solenoid control device 19 according to the present embodiment executes the short-circuit elimination detection process, the solenoid control device 19 cancels fixation of the duty ratio and turns off the alarm lamp 70 when the condition that it is determined that the short-circuit has been eliminated on the basis of the output from the overcurrent detection circuit 46 and the condition that the detected current value Id detected by the current detection circuit 44 is the normal value In are both satisfied. Hereinafter, the details will be described with reference to FIG. 7 and FIG. 8.

Figure 7:
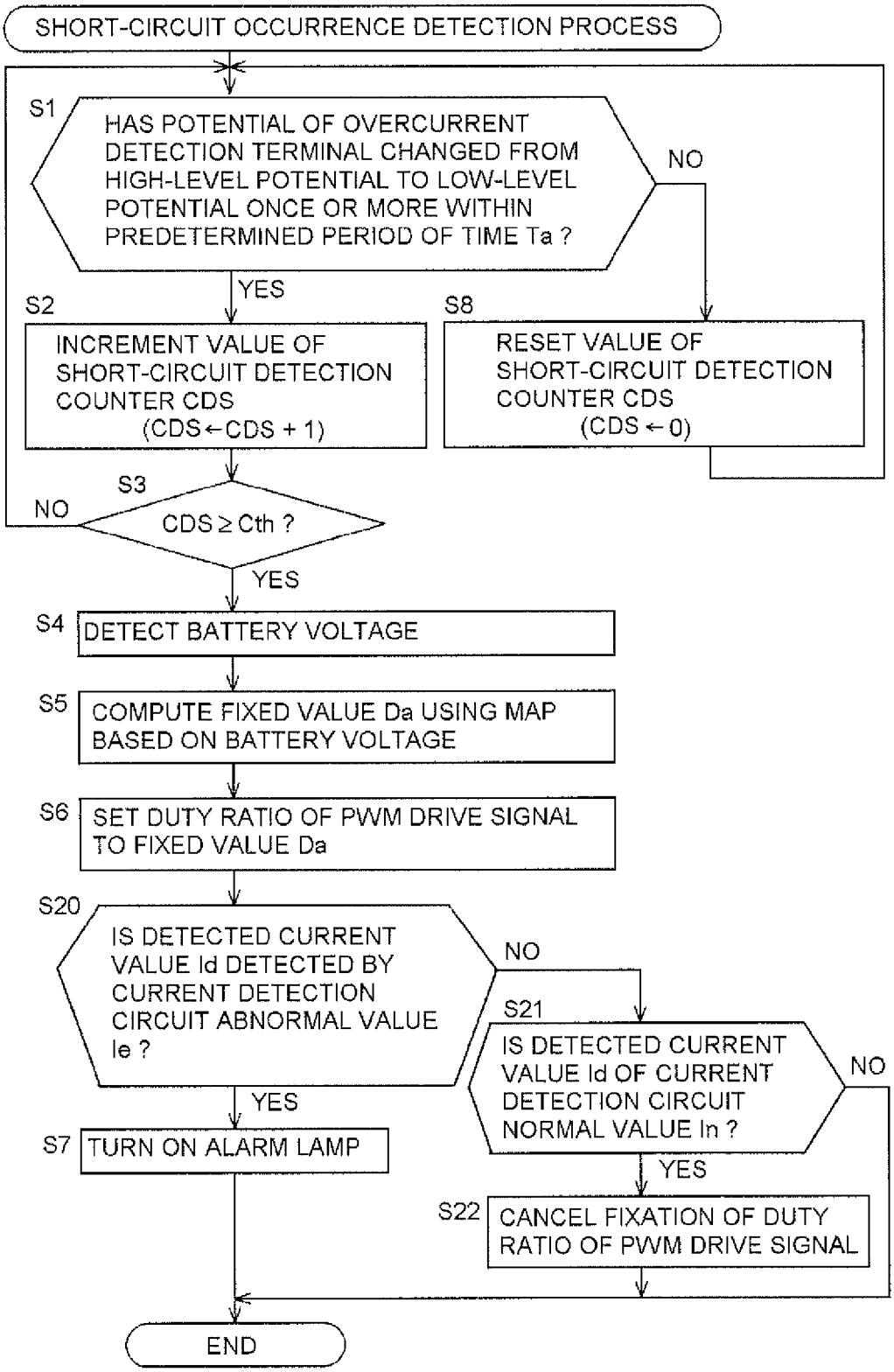
FIG. 7 is a flowchart that shows the procedure of a short-circuit occurrence detection process that is executed by a solenoid control device according to a second embodiment of the invention.

The short-circuit occurrence detection process that is executed by the microcomputer 43 will be described with reference to FIG. 7. In FIG. 7, the same processes as those shown in FIG. 5 will be denoted by the same reference symbols as those shown in FIG. 5, and the overlapping description will be omitted.

As shown in FIG. 7, the microcomputer 43 sets the duty ratio of the PWM drive signal to the fixed value Da (step S6), and then determines whether the detected current value Id detected by the current detection circuit 44 is the abnormal value Ie (step S20). Specifically, when the detected current value Id satisfies the relationship, "$Ie-\Delta I \leq Id \leq Ie+\Delta I$" where a predetermined value set in advance is $\Delta I$, the microcomputer 43 determines that the detected current value Id is the abnormal value Ie. When the detected current value Id is the abnormal value Ie (YES in step S20), the microcomputer 43 turns on the alarm lamp 70 (step S7).

Therefore, if the detected current value Id detected by the current detection circuit 44 indicates the abnormal value Ie when the duty ratio is fixed, that is, when there is a short-circuit between both terminals of the solenoid 30, the alarm lamp 70 turns on. Thus, the driver is able to reliably recognize occurrence of a short-circuit on the basis of the fact that the alarm lamp 70 is turned on.

On the other hand, when the detected current value Id is not the abnormal value Ie (NO in step S20), the microcomputer 43 determines whether the detected current value Id is the normal value In (step S21). Specifically, when the detected current value Id satisfies the relationship, "$In-\Delta I \leq Id \leq In+\Delta I$", the microcomputer 43 determines that the detected current value Id is the normal value In. When the detected current value Id is the normal value In (YES in step S21), the microcomputer 43 cancels fixation of the duty ratio (step S22).

Therefore, even if the duty ratio is erroneously fixed on the basis of the output from the overcurrent detection circuit 46, fixation of the duty ratio is cancelled when the detected current value Id detected by the current detection circuit 44 is the normal value In, that is, when there is actually no short-circuit. Thus, it is possible to avoid a situation where the duty ratio is erroneously fixed. When the detected current value Id is not the normal value In (NO in step S21), the microcomputer 43 ends the series of processes.

Figure 8:
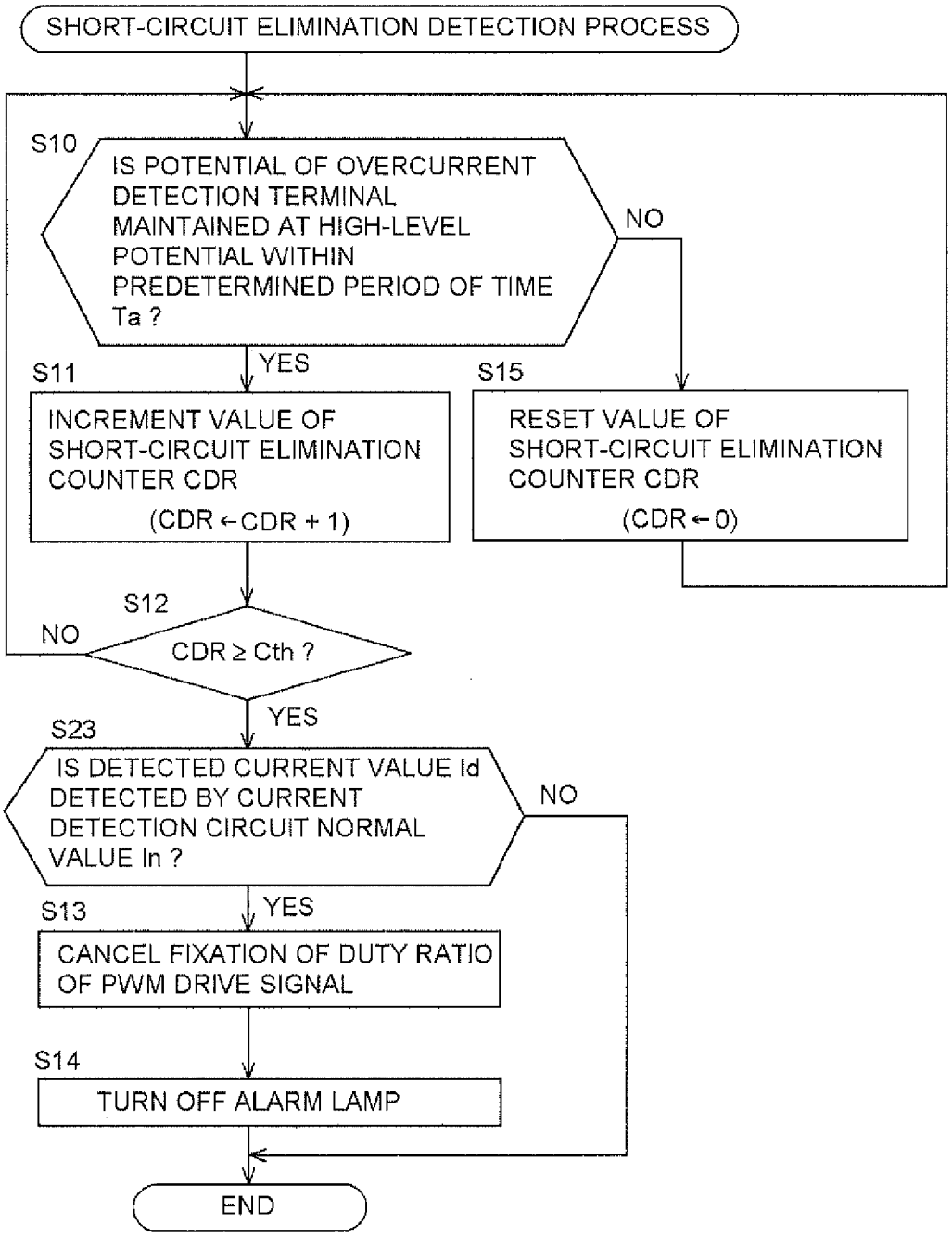
FIG. 8 is a flowchart that shows the procedure of a short-circuit elimination detection process that is executed by the solenoid control device according to the second embodiment.

Next, the short-circuit elimination detection process that is executed by the microcomputer 43 will be described with reference to FIG. 8 together with its operation. In FIG. 8, the same processes as those shown in FIG. 6 will be denoted by the same reference symbols as those shown in FIG. 6, and the overlapping description will be omitted.

As shown in FIG. 8, when the value of the short-circuit elimination counter CDR reaches the determination value Cth (YES in step S12), that is, when it is determined that the short-circuit has been eliminated, the microcomputer 43 determines whether the detected current value Id detected by the current detection circuit 44 is the normal value In (step S23). The process of step S23 is similar to the process of step S21 shown in FIG. 7. When the detected current value Id is the normal value In (YES in step S23), the microcomputer 43 cancels fixation of the duty ratio (step S13), and turns off the alarm lamp 70 (step S14). On the other hand, when the detected current value Id is not the normal value In (NO in step S23), the microcomputer 43 ends the series of processes. In this case, the microcomputer 43 executes the process shown in FIG. 8 again after a lapse of a predetermined period of time. Note that, at this time, the microcomputer 43 sets the value of the short-circuit elimination counter CDR to "0".

Therefore, even if elimination of the short-circuit is erroneously detected on the basis of the output from the overcurrent detection circuit 46, fixation of the duty ratio is not cancelled when the detected current value Id detected by the current detection circuit 44 is not the normal value, that is, the short-circuit is actually not eliminated. Thus, it is possible to avoid a situation where fixation of the duty ratio is erroneously cancelled. In addition, when the detected current value Id is the normal value In, that is, when the short-circuit has been eliminated, it is possible to reliably cancel fixation of the duty ratio and to turn off the alarm lamp 70.

As described above, with the solenoid control device according to the present embodiment, advantageous effects the same as or similar to (1) to (5) of the first embodiment and the following advantageous effects are obtained.

(6) If the detected current value Id detected by the current detection circuit 44 is the normal value In when the duty ratio is set to the fixed value Da, the solenoid control device 19 cancels fixation of the duty ratio. Thus, it is possible to avoid a situation where the duty ratio is erroneously fixed when there is no short-circuit between both terminals of the solenoid 30.

(7) If the detected current value Id detected by the current detection circuit 44 is the abnormal value Ie when the duty ratio is set to the fixed value Da, the solenoid control device 19 turns on the alarm lamp 70. Thus, the driver is able to reliably recognize occurrence of a short-circuit on the basis of the fact that the alarm lamp 70 turns on.

(8) The solenoid control device 19 cancels fixation of the duty ratio when the condition that it is determined that the short-circuit has been eliminated and the condition that the detected current value Id detected by the current detection circuit 44 is the normal value In are both satisfied. Therefore, it is possible to avoid a situation where fixation of the duty ratio is erroneously cancelled although the short-circuit is not eliminated.

(9) The solenoid control device 19 turns off the alarm lamp 70 when the condition that it is determined that the short-circuit has been eliminated and the condition that the detected current value Id detected by the current detection circuit 44 is the normal value In are both satisfied. Therefore, when the short-circuit has been eliminated, it is possible to reliably turn off the alarm lamp 70.

The following modifications may be made to the above-described embodiments.

Figure 9:
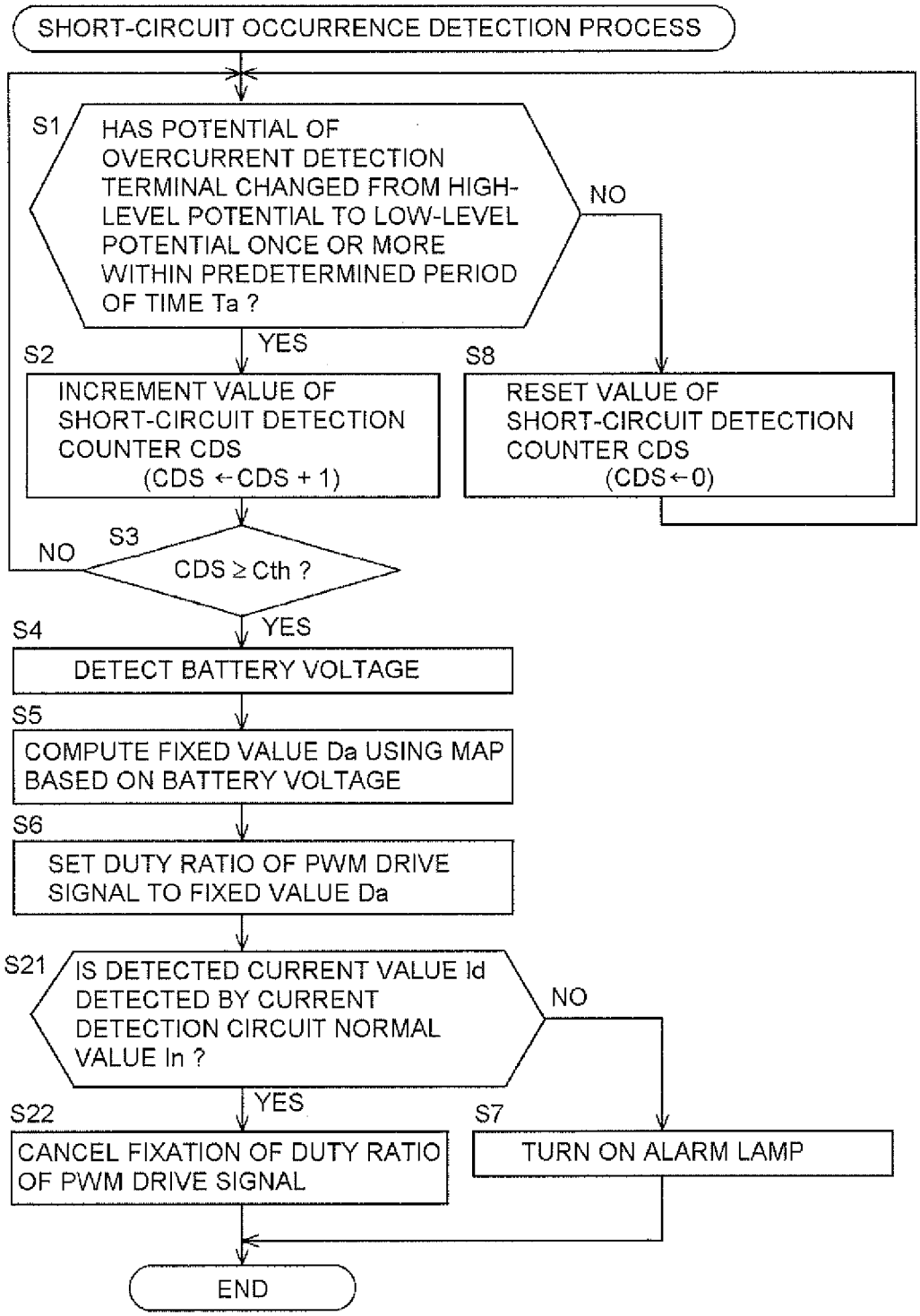
FIG. 9 is a flowchart that shows the procedure of a short-circuit occurrence detection process according to an alternative embodiment.

The process shown in FIG. 9 may be executed instead of the process shown in FIG. 7 in the second embodiment. Specifically, as shown in FIG. 9, the microcomputer 43 sets the duty ratio of the PWM drive signal to the fixed value Da (step S6), and then determines whether the detected current value Id detected by the current detection circuit 44 is the normal value In (step S21). When the detected current value Id is the normal value In (YES in step S21), fixation of the duty ratio is cancelled (step S22). On the other hand, when the detected current value Id is not the normal value In (NO in step S21), the microcomputer 43 turns on the alarm lamp 70 (step S7). With this configuration as well, advantageous effects similar to those of the second embodiment are obtained.

In the second embodiment, it may be determined that the detected current value Id is the normal value In on the condition that the detected current value Id agrees with the normal value In. In addition, it may be determined that the detected current value Id is the abnormal value Ie on the condition that the detected current value Id agrees with the abnormal value Ie.

In the above-described embodiments, the predetermined period of time that is used in the process of step S1 illustrated in FIG. 5 and FIG. 7 and the predetermined period of time that is used in the process of step S10 illustrated in FIG. 6 and FIG. 8 are set to the same period of time Ta. Alternatively, these periods of time may be set to different periods of time. In addition, the determination value that is used in the process of step S3 illustrated in FIG. 5 and FIG. 7 and the determination value that is used in the process of step S12 illustrated in FIG. 6 and FIG. 8 may also be set to different values.

In the above-described embodiments, when a short-circuit between both terminals of the solenoid 30 is detected, the alarm lamp 70 is turned on. However, this configuration may be omitted. Specifically, in the first embodiment, the process of step S7 in the short-circuit occurrence detection process illustrated in FIG. 5 and the process of step S14 in the short-circuit elimination detection process illustrated in FIG. 6 may be omitted. In addition, in the second embodiment, the processes of step S20 and step S7 in the short-circuit occurrence detection process illustrated in FIG. 7 may be omitted, and the process of step S21 may be executed subsequently to the process of step S6. In addition, the process of step S14 in the short-circuit elimination detection process illustrated in FIG. 8 may be omitted.

In a solenoid control device that has such a temperature characteristic that the drive current for the solenoid 30 changes on the basis of an outside air temperature, the duty ratio fixed value Da may be set on the basis of the outside air temperature. Specifically, as indicated by a dashed line in FIG. 2, a temperature sensor 24 that detects an outside air temperature is provided. The microcomputer 43 computes the duty ratio fixed value Da using a map on the basis of the outside air temperature that is detected by the temperature sensor 24. The map that indicates the correlation between the duty ratio fixed value Da and the outside air temperature has such a map form that the duty ratio fixed value Da becomes smaller as the outside air temperature becomes higher. In addition, the duty ratio fixed value Da may be set on the basis of both the battery voltage and the outside air temperature or the duty ratio fixed value Da may be set on the basis of one of the battery voltage and the outside air temperature.

In the above-described embodiments, the duty ratio fixed value Da is set on the basis of the battery voltage. Alternatively, the duty ratio fixed value Da may be set to a predetermined constant value.

In the above-described embodiments, when there occurs a short-circuit between both terminals of the solenoid 30, the duty ratio of the PWM drive signal is set to the fixed value Da. However, this process may be omitted and only the process of turning on the alarm lamp 70 may be carried out. Specifically, in the first embodiment, the process of step S6 in the short-circuit occurrence detection process illustrated in FIG. 5 may be omitted. In addition, in the second embodiment, step S6, step S21 and step S22 in the short-circuit occurrence detection process illustrated in FIG. 7 may be omitted.

The configuration of the overcurrent detection circuit 46 may be modified as needed. The overcurrent detection circuit 46 may have any configuration as long as the overcurrent detection circuit 46 outputs an overcurrent detection signal when the drive current for the solenoid 30 reaches the overcurrent determination current value. In addition, the configuration of the drive circuit 42 may also be modified as needed.

In the above-described embodiments, the MOSFET 41 is used as the switching element that allows or interrupts supply of power from the battery 50 to the solenoid 30. Alternatively, an appropriate switching element may be used.

In the above-described embodiments, the alarm lamp 70 is used as alarm means. Alternatively, for example, a speaker, or the like, that issues an alarm by sound may be used.

In the above-described embodiments, the invention is applied to the solenoid control device that is provided in the hydraulic power steering system of the vehicle. However, the invention may be applied to an appropriate solenoid control device. The invention may be applied to any solenoid control device as long as the solenoid control device executes feedback control such that the drive current for the solenoid follows a target current, by driving, through PWM, the switching element provided on the power supply line to the solenoid.

What is claimed is:

1. A solenoid control device comprising:

a microcomputer that is configured to control a drive current for a solenoid;

a current detection unit that detects a drive current that is supplied to the solenoid via a power supply line, the solenoid control device executing feedback control such that a detected current value detected by the current detection unit follows a target current value, by driving, through pulse width modulation, a switching element provided on the power supply line; and an overcurrent detection unit that outputs an overcurrent detection signal when the drive current for the solenoid reaches an overcurrent determination current value, wherein the overcurrent detection unit determines that an overcurrent is generated based on the overcurrent detection signal; and when the overcurrent detection unit is repeating an output of the overcurrent detection signal and a stop of the output of the overcurrent detection signal, the microcomputer determines that a short-circuit exists between both terminals of the solenoid.

2. The solenoid control device according to claim 1, wherein when a short-circuit is detected, a duty ratio of a PWM drive signal for the switching element is set to a fixed value.

3. The solenoid control device according to claim 2, wherein:

when the duty ratio is set to the fixed value and there is no short-circuit, a current value detected by the current detection unit is defined as a normal value; and if the detected current value is the normal value when the duty ratio is set to the fixed value, fixation of the duty ratio is cancelled.

4. The solenoid control device according to claim 2, wherein:

when the short-circuit is detected, the microcomputer further monitors whether the overcurrent detection unit is repeating an output of the overcurrent detection signal and a stop of the output of the overcurrent detection signal to determine whether the short-circuit has been eliminated; and when the short-circuit is eliminated, fixation of the duty ratio is cancelled.

5. The solenoid control device according to claim 4, wherein:

when the duty ratio is set to the fixed value and there is no short-circuit, the current value detected by the current detection unit is defined as a normal value; and when the microcomputer determines that the short-circuit is eliminated, and the detected current value is the normal value, fixation of the duty ratio is cancelled.

6. The solenoid control device according to claim 2, wherein the microcomputer sets the fixed value on the basis of a voltage of a battery that serves as a drive power supply source for the solenoid.

7. The solenoid control device according to claim 2, wherein the microcomputer sets the fixed value on the basis of an outside air temperature.

* * * * *